US006481431B1

(12) United States Patent
Summers

(10) Patent No.: US 6,481,431 B1
(45) Date of Patent: Nov. 19, 2002

(54) BOWSTRING RELEASE GLOVE

(76) Inventor: Gregory E. Summers, 105 Overlink Dr., Lynchburg, VA (US) 24503

( * ) Notice: Subject to any disclaimer, the term of this patent is extended or adjusted under 35 U.S.C. 154(b) by 0 days.

(21) Appl. No.: 09/766,833

(22) Filed: Jan. 23, 2001

(51) Int. Cl.[7] ..... F41B 5/18
(52) U.S. Cl. ..... 124/35.2
(58) Field of Search ..... 124/1, 35.2

(56) References Cited

U.S. PATENT DOCUMENTS

| | | | | |
|---|---|---|---|---|
| 3,028,852 A | | 4/1962 | Sutton, Jr. | |
| 3,072,115 A | | 1/1963 | Johnson | |
| 4,509,497 A | | 4/1985 | Garvison | |
| 4,791,908 A | | 12/1988 | Pellis | |
| 4,831,997 A | | 5/1989 | Greene | |
| 4,981,128 A | | 1/1991 | Garvison | 124/35.2 |
| 5,020,508 A | | 6/1991 | Greene, Jr. | 124/35.2 |
| 5,323,754 A | * | 6/1994 | Pittman et al. | 124/35.2 |
| 5,357,939 A | | 10/1994 | Tentler et al. | 124/35.2 |
| 5,595,167 A | | 1/1997 | Scott | 124/35.2 |
| 5,615,662 A | | 4/1997 | Tentler et al. | 124/35.2 |
| 5,653,214 A | | 8/1997 | Lynn | 124/35.2 |
| 5,857,452 A | | 1/1999 | Troncoso | 124/35.2 |
| 5,937,841 A | | 8/1999 | Summers et al. | 124/35.2 |
| 6,125,833 A | | 10/2000 | Tentler et al. | 124/35.2 |
| 6,205,991 B1 | | 3/2001 | Summers et al. | 124/35.2 |

* cited by examiner

*Primary Examiner*—John A. Ricci
(74) *Attorney, Agent, or Firm*—Nixon & Vanderhye P.C.

(57) ABSTRACT

A bowstring release glove includes an elongated wrist wrap portion adapted to surround and be detachably secured to a user's wrist; a palm grip portion carrying a bowstring release, the palm grip portion fixedly secured at one end to the wrist wrap portion and detachably secured at an opposite end to the wrist wrap portion. The palm grip portion and the bowstring release are movable between operative and inoperative positions while the wrist wrap portion remains secured to the user's wrist.

21 Claims, 5 Drawing Sheets

BOWSTRING RELEASE GLOVE

The present invention relates to bowstring release devices and, more specifically, to a bowstring release glove for use in hunting or archery competition.

BACKGROUND AND SUMMARY OF THE INVENTION

Various release devices are utilized in archery to assist the archer in pulling a bowstring to a fully drawn position and then releasing the bowstring to fire the arrow. Many of these devices include mechanical grippers which engage the bowstring directly, or which engage nock elements mounted on the bowstring. Other devices uses rope looped about the bowstring as the release mechanism.

It is also known to use wrist straps or "gloves" connected to the release devices to enhance control and accuracy of the release device. Examples of such wrist straps can be found in U.S. Pat. Nos. 5,020,508; 4,981,128; 4,791,908; and 4,509,497.

The present invention relates to a bowstring release glove designed to be worn through and around the hand to evenly distribute the pull of the bow draw weight between a palm grip and the back of the hand, allowing for greater weight to be pulled with less physical exertion. A significant feature of this glove design is that the palm grip portion and the release device itself can be moved to an out-of-the-way position, along the back of the hand when not in use. In addition, the release glove of this invention is usable with any of a variety of mechanical release devices.

More specifically, in an exemplary embodiment of the invention, the glove portion includes an elongated strap that wraps about the wrist, and a palm grip portion that extends across the palm of the hand, secured to one end of the strap The opposite end of the palm grip portion is detachably connectable to an intermediate portion of the elongated wrist strap. The palm grip portion also incorporates a connector to which the bowstring release is attached. By providing a releasable connector at the one end of the palm grip portion, it will be appreciated that the palm grip portion, including the release, can be folded or swung to an out-of-the-way position, essentially across and parallel to the back of the hand, and secured in that position using the same releasable connector, thereby freeing the hand for attending to other matters, for example, eating, drinking, climbing tree stands and the like. The detachable connection between the palm grip portion and the wrist strap may be of the known press and snap type, although any alternative suitable fastener may also be employed.

The connector plate by which the release is secured to the palm grip portion of the glove release includes a boss having a smooth bore adapted to rotatably receive a threaded stud or bolt extending rearwardly from the release and secured by a nut, thus providing the release with 360° rotation capability relative to the connector (and to the glove). The connector plate also includes angled slots by which the connector is secured to the palm grip portion. Slightly differently located slots are provided for both right and left hand usage.

The ends of the wrist strap portion of the glove may be overlapped and secured by means of a hook and loop type fastening device, or by a belt buckle type connector.

Accordingly, in its broader aspects, the invention provides a bowstring release glove comprising an elongated wrist wrap portion having first and second ends, adapted to surround and be detachably secured to a user's wrist; a palm grip portion carrying a bowstring release, the palm grip portion fixedly secured at one end to the first end of the wrist wrap portion and detachably secured at an opposite end to the wrist wrap portion at a location between the first and second ends, thereby enabling the palm grip portion and the bowstring release to move between operative and inoperative positions while the wrist wrap portion remains secured to the user's wrist.

In another aspect, the invention provides a bowstring release glove comprising a wrist wrap portion adapted to be secured to the user's wrist; a palm grip portion secured to the wrist wrap portion; a bowstring release carried by the palm grip portion; and means for securing the palm grip portion and the bowstring release to the wrist wrap portion in a first operative position, and for moving the palm grip portion and the bowstring release to a second inoperative position while the palm grip portion is secured on the user's wrist.

In still another aspect, the present invention relates to a bowstring glove release comprising an elongated wrist wrap portion having a first end and a second end; a first fastening strap connected at a location proximate the first end with a first fastener attached to a remote end of the first fastening strap and a second fastener attached near a proximate end of the first fastening strap; a buckle fastened at a location proximate the second end and adapted to permit the first fastener strap to be threaded through the buckle and folded back on itself such that the first and second fasteners can be engaged to secure the wrist wrap portion to a user's wrist; a palm grip portion secured at one end to the second end of the wrist wrap portion and adapted to extend across the user's palm; a bowstring release carried by the palm grip portion, an opposite end of the palm grip portion detachably connectable to the wrist wrap portion, to thereby allow the palm grip portion and the release to be swung away from the user's palm and to overlie the back of the user's hand in an inoperative position when the bowstring release device is not in use and without removing the wrist wrap portion.

DETAILED DESCRIPTION OF THE INVENTION

Figure 1:
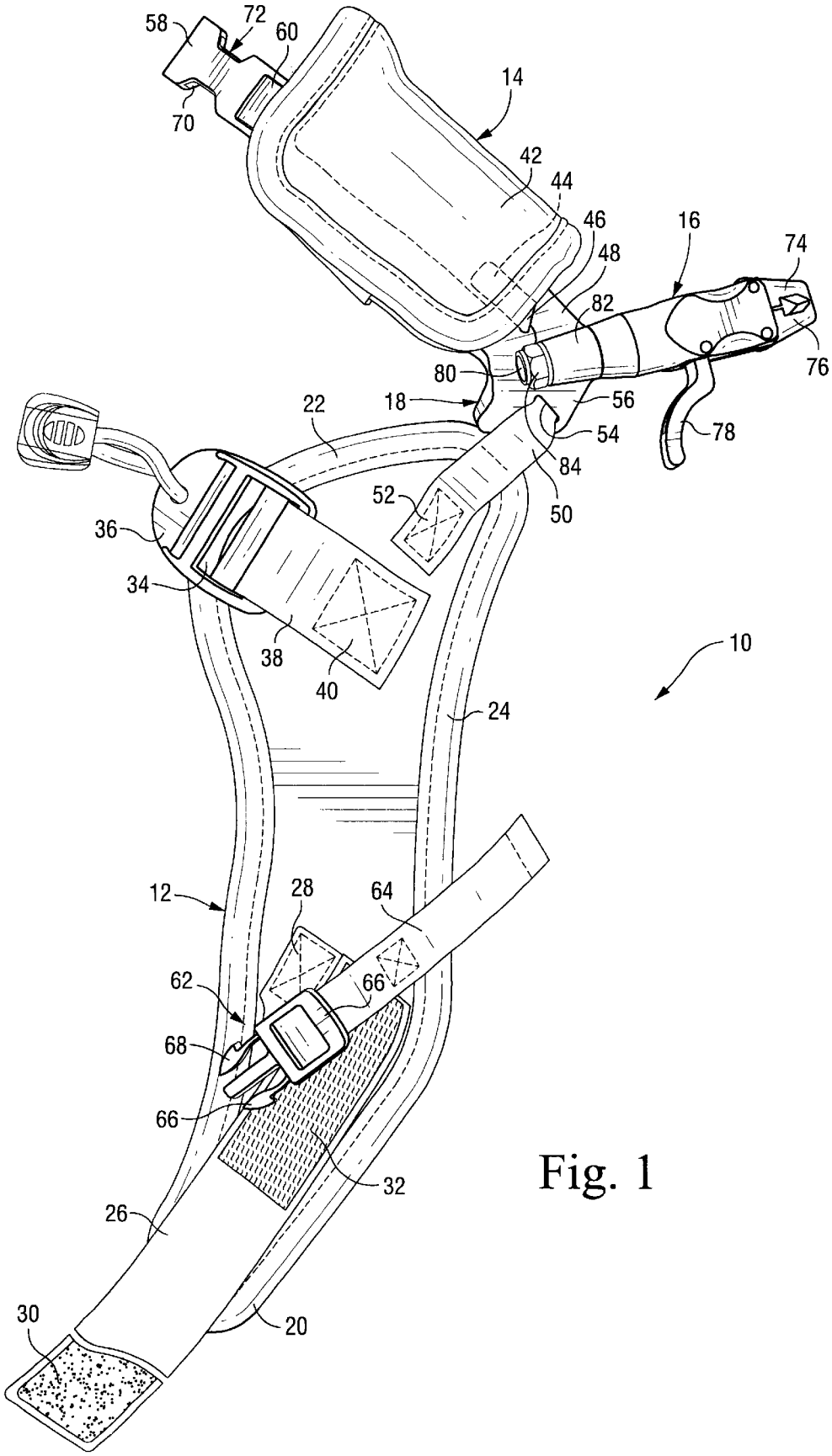
FIG. 1 is a plan view of a release glove in accordance with an exemplary embodiment of the invention, in an open, laid-out position.
Figure 2:
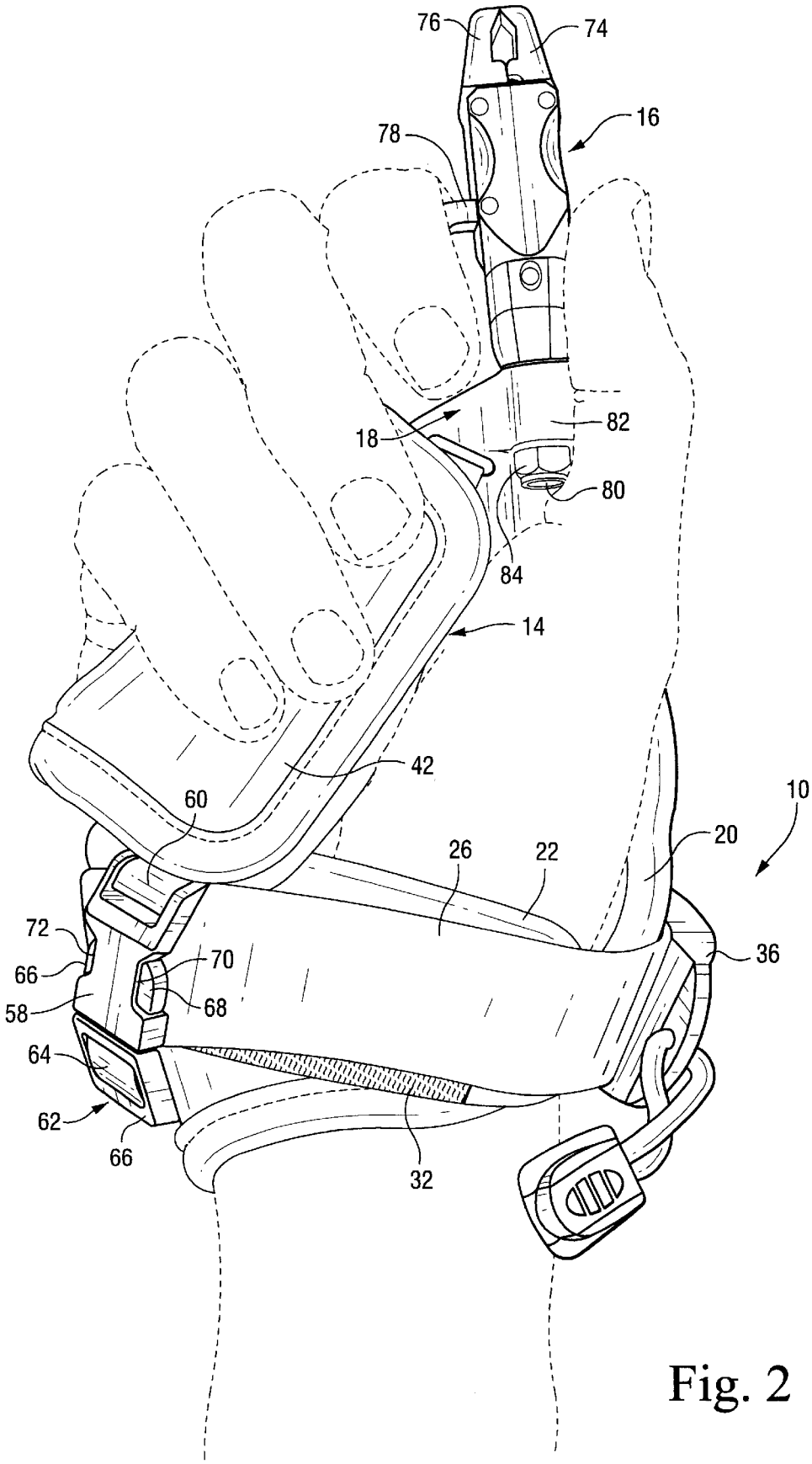
FIG. 2 illustrates the bowstring release glove of FIG. 1, shown in place on a user's hand.
Figure 3:
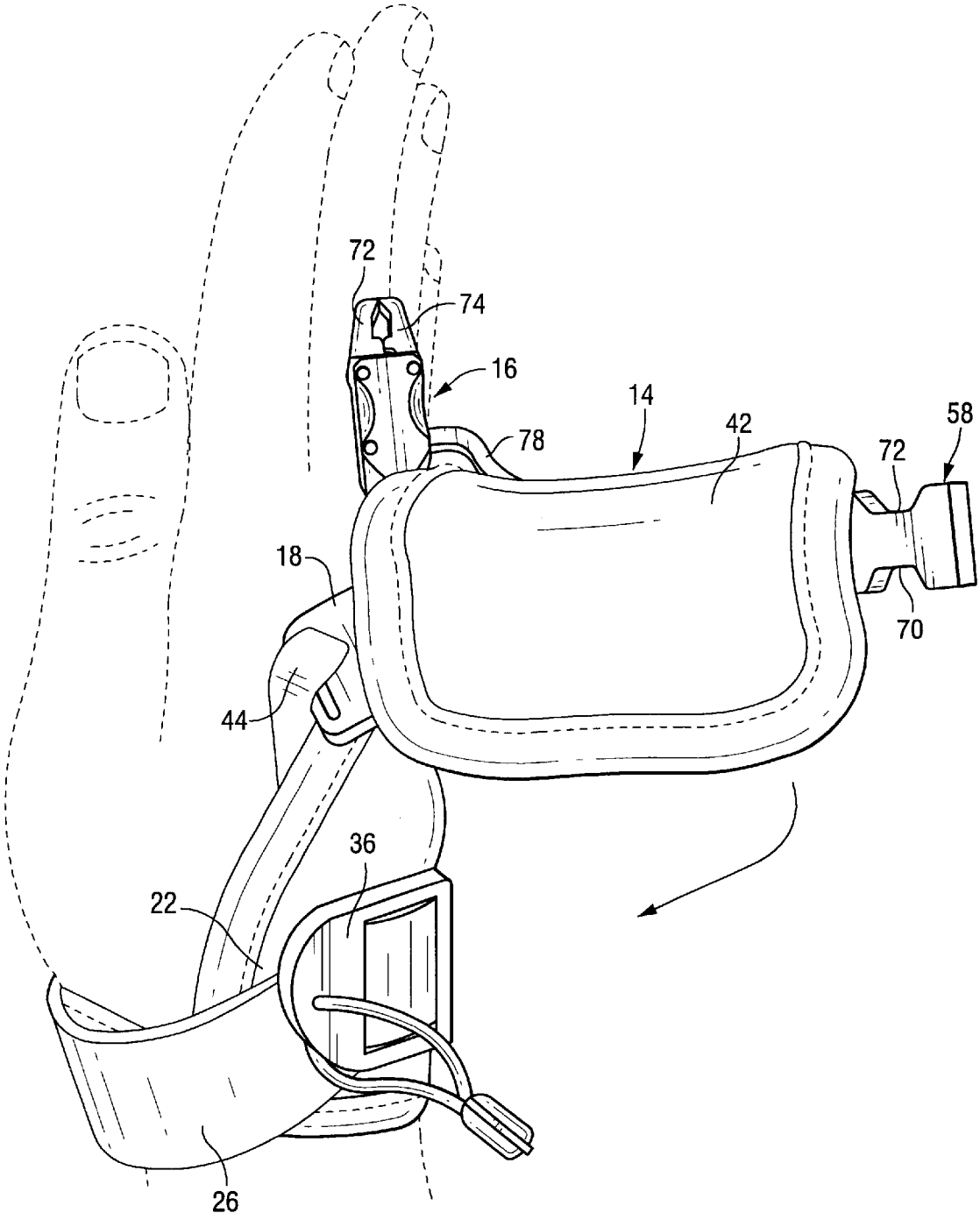
FIG. 3 illustrates the bowstring release glove as shown in FIG. 1, but with the palm grip and release disconnected at one end from the wrist strap, and partially folded back away from the palm of the hand.
Figure 4:
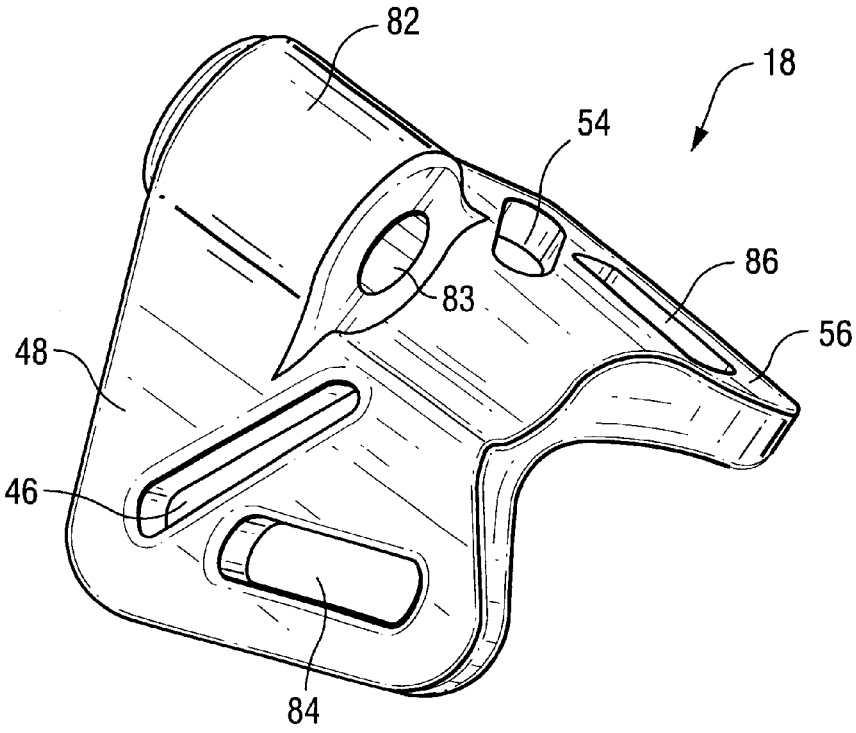
FIG. 4 is a perspective view of a connector utilized in the glove release shown in FIGS. 1 through 3.
Figure 5:
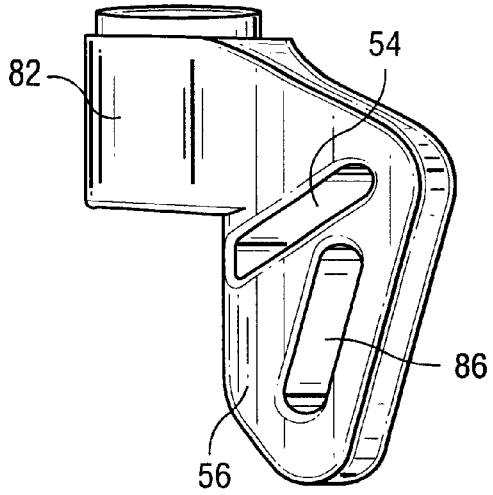
FIG. 5 is a side elevation of the connector shown in FIG. 4.
Figure 6:
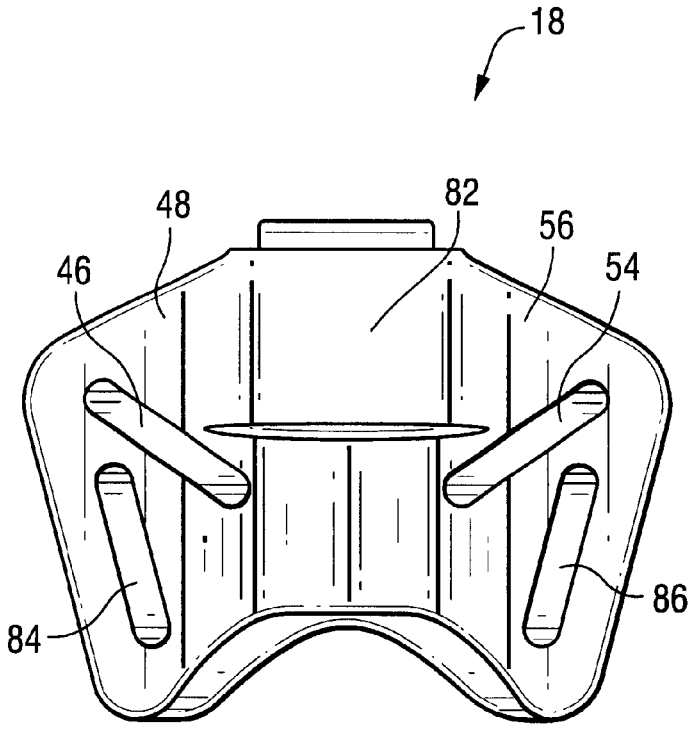
FIG. 6 is a bottom plan view of the connector shown in FIG. 4.
Figure 7:
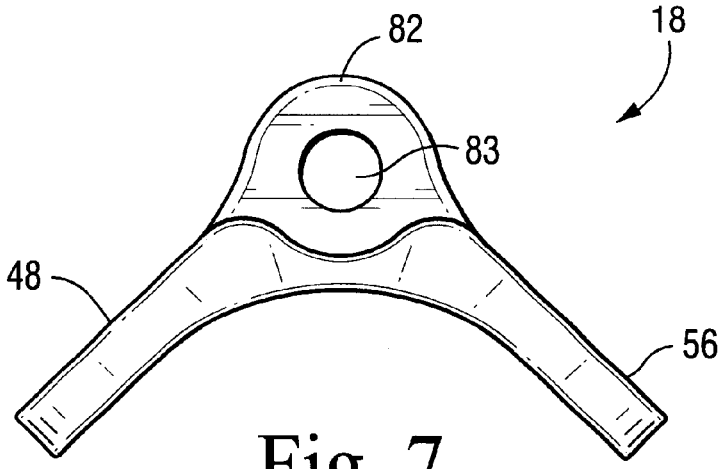
FIG. 7 is a rear end elevation of the connector shown in FIG. 4.

Referring initially to FIGS. 1-3, and especially FIG. 1, the bowstring release glove 10 generally includes an elongated wrist wrap 12. The glove also includes a palm grip portion 14 that carries a bowstring release 16 via a connector plate 18. As further explained below, and as shown in FIG. 1, the wrist wrap portion 12 is adapted to surround and be secured to a user's wrist, while the palm grip portion 14 extends across the palm of the user's hand, at the same time locating the bowstring release 16 in a firing position, as best seen in FIG. 2.

More specifically, the wrist wrap portion (or simply, wrist wrap) 12 has a first end 20 and a second end 22 and may include, for example, two layers of fabric with light padding material enclosed therein. The peripheral edges of the layers of material may be bound and stitched with, for example, vinyl or matching fabric edging 24. A first fastener strap 26 is secured to the wrist strap portion proximate the first end 20 (as shown at 28) and includes a first "fastener" 30 at a distal or free end thereof. The fastener 30 may be a pad of Velcro® brand hook and loop fastener material.

A second fastener, i.e., a cooperating pad 32 of hook and loop fastener material, is secured on the same side of the fastener strap 26, but adjacent the proximate end thereof.

The fastener strap 26 is adapted to be looped through a slot 34 in a buckle 36 secured near the second end 22 of the wrist wrap portion via a short strap 38 stitched to the wrist strap portion at 40. It will be appreciated that upon applying the wrist wrap 12 about the user's wrist, the fastener strap 26 may be passed through the slot 34 and looped or folded back on itself such that the fastener pad 30 can be pressed onto the fastener pad 32 to firmly secure the wrist wrap portion in place. Note that the length of pad 32 can be altered as desired to permit a degree of adjustability with respect to the strap 26. It will be appreciated that the hook and loop type fastener may be replaced by a conventional adjustable "belt buckle" or other suitable connection device(s).

The palm grip portion 14 includes a palm grip 42 that may comprise padded and possibly reinforced fabric folded over and stitched to provide a relatively thick, soft grip. The connector plate 18 is attached to the palm grip 42 via a strap 44 that is looped through a slot 46 in a first wing portion 48 of the connector plate, and stitched to the palm grip. Another strap 50 secured at 52 to the second end 22 of the wrist wrap 12 is looped through a slot 54 in a second wing portion 56 of the connector and stitched to the wrist wrap, also at 52.

A first female component 58 of a snap-in type connector is secured via strap 60 to the opposite end of the palm grip 42 and is adapted to cooperate with a male component 62 of the snap-in type connector that is secured via a strap 64 to the wrist wrap 12 adjacent the attached end of the fastener strap 26, i.e., at a location intermediate the first and second ends 20, 22 of the wrist wrap. The male component 62 incorporates a buckle 66 that allows the male component 62 to be adjustably moved along the strap 64. Male component 62 includes a pair of flexible prongs 66, 68 that, as is well known, may be pressed or squeezed inwardly to permit insertion into the female component 58. Prongs 66, 68 project through the apertures 70, 72 in the female component 58. This arrangement allows the male component to be detached from the female component, again by squeezing the prongs 66, 68 inwardly and pulling the male component 62 out of the female component 58.

The bowstring release 16 includes a pair of jaws 74, 76 and a trigger 78. The release may be similar to those described in my prior U.S. Pat. Nos. 5,680,851 or 5,685,286, but the glove may also be used with other bowstring release devices. A threaded shaft 80 extends rearwardly from the release and passes through a raised boss 82 in the connector 18 and is secured by a nut 84. The boss 82 is formed with a smooth bore 83, thus permitting the shaft 80 (and release 16) to freely rotate relative to the connector 18 and thus to the glove itself, about the axis of the shaft 80 (that corresponds to the longitudinal axis of the release). This arrangement minimizes torque on the bowstring.

The connector plate 18 is best seen in FIGS. 4 through 7. The connector plate 18 includes the wing portions 48, 56 mentioned above that form a generally V-shape. The raised boss 82 lies at the intersection of the wing portions 48, 56 on the "exterior" side thereof. Each wing portion is provided with a pair of slots 46, 84 and 54, 86, respectively. The slots of each pair are arranged angularly relative to each other, providing flexibility with respect to the attachment of straps 44, 50. This configuration is especially advantageous in adapting the release glove to left or right-handed users.

In use, the user wraps the wrist wrap 12 about the wrist and secures the same by pulling the strap 26 through the slot 34, and looping or folding the strap back on itself so that the fastener pad 30 can be applied to the fastener pad 32. The palm grip portion 14 is then pulled across the palm of the hand and the male connector 62 inserted into the mating female connector 58. The palm grip portion 14 is now in an operative or firing position, with the release 16 accurately located such that the user can rest the thumb on top of the release, with the index finger adjacent the release trigger 78 as illustrated in FIG. 2. In the event the user desires to free up the hand for other activity, but without having to remove the release glove 10, the user disconnects the male connector 62 from the female connector 58 and swings or folds the palm grip portion 14 and release 16 rearwardly, away from the thumb and index finger as shown in FIG. 3. The palm grip portion can be folded or swung completely across the back of the hand, and across the back of the wrist wrap portion such that the female connector 58 can be re-engaged with the male connector 62, thus releasably holding the palm grip portion 14 and release 16 in an inoperative, out-of-the-way position. In this regard, because the male connector 62 is secured to the flexible strap 64, the connector can be easily swung toward the other side of the hand for re-engagement with the female connector 58.

When the user is ready to resume firing, the male connector 58 is disconnected from the female connector 62, and the palm grip portion 14 and release 16 are again pulled across the palm such that connector components 58, 62 can be re-engaged in the FIG. 2 position.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring release glove comprising:

an elongated wrist wrap portion having first and second ends and adapted to surround and be detachably secured to a user's wrist; a palm grip portion carrying a bowstring release, said palm grip portion fixedly secured at one end to said first end of said wrist wrap portion and detachably secured at an opposite end to said wrist wrap portion at a location between said first and second ends, thereby enabling said palm grip portion and said bowstring release to move between operative and inoperative positions while the wrist wrap portion remains secured to the user's wrist.

2. The bowstring release glove of claim 1 wherein said opposite end of said palm grip portion is detachably secured to said wrist wrap portion by a connector that is used to secure the palm grip portion in both the operative and inoperative positions.

3. The bowstring release glove of claim 1 wherein said one end of said palm grip portion is permanently secured to said wrist wrap portion by a flexible strap.

4. The bowstring release glove of claim 1 wherein said wrist wrap portion includes fastener means for adjustably securing the wrist wrap portion to the user's wrist.

5. The bowstring release glove of claim 1 wherein said palm grip portion further comprises a padded palm grip.

6. The bowstring release glove of claim 1 including a connector plate between said palm grip portion and said bowstring release, said connector plate and said bowstring release having cooperating means for allowing said bowstring release to freely rotate 360° about a longitudinal axis of said bowstring release.

7. The bowstring release glove of claim 1 wherein said bowstring release includes a housing carrying a pair of jaws and a trigger.

8. The bowstring release glove of claim 7 wherein a shaft extends rearwardly from said housing, said shaft having a threaded end; a connector plate interposed between said bowstring release and said palm grip portion, said connector plate having a boss provided with a smooth bore for receiving said shaft, and a nut applied to said threaded end to thereby secure said bowstring release to said connector plate while permitting said bowstring release to rotate about an axis of said shaft relative to said connector plate.

9. The bowstring release glove of claim 8 including a first fastening strap between said connector plate and said palm grip and a second fastening strap between said connector plate and said wrist wrap portion.

10. A bowstring release glove comprising a wrist wrap portion adapted to be secured to the user's wrist; a palm grip portion secured at one end to said wrist wrap portion; a bowstring release carried by said palm grip portion; and means for releasably securing an opposite end of said palm grip portion to said wrist wrap portion in a first operative position, and for releasing and moving said palm grip portion and said bowstring release to a second inoperative position while said wrist wrap portion is secured on the user's wrist.

11. The bowstring release glove of claim 10 wherein said wrist wrap portion includes fastener means for adjustably securing the wrist wrap portion to the user's wrist.

12. The bowstring release glove of claim 10 wherein said palm grip portion further comprises a padded palm grip.

13. The bowstring release glove of claim 10 including a connector plate between said palm grip portion and said bowstring release, said connector plate and said bowstring release having cooperating means for allowing said bowstring release to freely rotate 360° about a longitudinal axis of said bowstring release.

14. The bowstring release glove of claim 10 wherein said bowstring release includes a housing carrying a pair of jaws and a trigger.

15. The bowstring release glove of claim 10 including means for securing said palm grip portion and said bowstring release to said wrist wrap portion in said inoperative position.

16. A bowstring release glove comprising:

a wrist wrap portion adapted to be secured to the user's wrist;

a palm grip portion secured to said wrist wrap portion;

a bowstring release carried by said palm grip portion, said bowstring release including a housing carrying a pair of jaws and a trigger, a shaft extending rearwardly from said housing, said shaft having a threaded end; a connector plate interposed between said bowstring release and said palm grip portion, said connector plate having a boss provided with a smooth bore for receiving said shaft, and a nut applied to said threaded end to thereby secure said bowstring release to said connector plate while permitting said bowstring release to rotate about an axis of said shaft relative to said connector plate; and means for securing said palm grip portion and said bowstring release to said wrist wrap portion in a first operative position, and for moving said palm grip portion and said bowstring release to a second inoperative position while said palm grip portion is secured on the user's wrist.

17. The bowstring release glove of claim 16 including a first fastening strap between said connector plate and said palm grip and a second fastening strap between said connector plate and said wrist wrap portion.

18. A bowstring glove release comprising:

an elongated wrist wrap portion having a first end and a second end; a first fastening strap connected at a location proximate said first end with a first fastener attached to a remote end of said first fastening strap and a second fastener attached near a proximate end of said first fastening strap; a buckle fastened at a location proximate said second end and adapted to permit said first fastener strap to be threaded through said buckle and folded back on itself such that said first and second fasteners can be engaged to secure the wrist wrap portion to a user's wrist; a palm grip portion secured at one end to said second end of said wrist wrap portion and adapted to extend across the user's palm; a bowstring release carried by said palm grip portion, an opposite end of said palm grip portion detachably connectable to said wrist wrap portion, to thereby allow said palm grip portion and said release to be swung away from the user's palm and to overlie the back of the user's hand in an inoperative position when the bowstring release device is not in use and without removing the wrist wrap portion.

19. The bowstring glove release of claim 18 wherein said palm grip portion is reattachable to the wrist wrap portion in the inoperative position.

20. The bowstring glove release of claim 19 wherein said opposite end of said palm grip portion is detachably secured to said wrist wrap portion by a connector that is used to secure the palm grip portion in both operative and inoperative positions.

21. The bowstring glove release of claim 18 wherein said bowstring release is secured to a connector plate via a shaft such that said release is freely rotatable about an axis of said shaft, relative to said connector plate.

* * * * *